US005657062A

United States Patent [19]

Shiraishi et al.

[11] Patent Number: 5,657,062

[45] Date of Patent: Aug. 12, 1997

[54] INK DISCHARGING DEVICE

[75] Inventors: Tadashi Shiraishi, Kasuga; Mitsuhide Matsuda, Fukuoka-ken; Tomoyuki Noguchi, Kasuga; Masaharu Oyama, Chikushino, all of Japan

[73] Assignee: Matsushita Electric Industrial Co., Ltd., Osaka, Japan

[21] Appl. No.: 390,378

[22] Filed: Feb. 16, 1995

Related U.S. Application Data

[63] Continuation of Ser. No. 970,390, Nov. 2, 1992, abandoned.

[30] Foreign Application Priority Data

Nov. 13, 1991 [JP] Japan ..... 3-296817

[51] Int. Cl.[6] ..... B41J 2/05

[52] U.S. Cl. ..... 347/55; 347/61

[58] Field of Search ..... 347/54, 55, 61

[56] References Cited

U.S. PATENT DOCUMENTS

| | | | |
|---|---|---|---|
| 3,179,042 | 4/1965 | Naiman | 101/1 |
| 4,502,054 | 2/1985 | Brescia et al. | 346/75 |
| 5,159,355 | 10/1992 | Horio et al. | 347/55 |

FOREIGN PATENT DOCUMENTS

| | | | |
|---|---|---|---|
| 0167465 | 12/1981 | Japan | 347/55 |
| 0215357 | 12/1983 | Japan | 347/55 |
| 267146 | 11/1987 | Japan | 347/55 |
| 0110170 | 5/1991 | Japan . | |
| 180353 | 8/1991 | Japan . | |
| 246050 | 11/1991 | Japan | 347/55 |

*Primary Examiner*—N. Le

*Attorney, Agent, or Firm*—Pollock, Vande Sande & Priddy

[57] ABSTRACT

An ink discharging device includes arrayed nozzle holes and corresponding ink flow paths leading thereto. An electrode is provided between the adjacent ink flow paths in such a manner as to be exposed to both of the adjacent ink flow paths so that each electrode works as a common electrode for both of the adjacent ink flow paths. By energizing a conductive ink between the electrodes within the corresponding ink flow path, a portion of the conductive ink is discharged through the corresponding nozzle hole.

13 Claims, 4 Drawing Sheets

INK DISCHARGING DEVICE

This application is a continuation of Ser. No. 07/970,390, filed on Nov. 2, 1992 abandoned.

BACKGROUND OF THE INVENTION

1. Field of the Invention

The present invention relates generally to an ink discharging device. More specifically, the present invention relates to an ink jetting device to be used in an ink jet printer, wherein a conductive ink is directly energized to be heated to boil so that the ink is jetted out by an expansion pressure of the vaporized ink.

2. Description of the Prior Art

Recently, ink jet printers with ink jetting devices therein have been widely used as, for example, printers for office computers' outputs for reasons of, such as, silence or less noisiness of their printing operations.

U.S. Pat. No. 3,179,042 discloses one of such ink jetting devices, in which a conductive ink is directly energized to vaporize by means of its own Joule heat so that an expansion pressure of the vaporized ink gas forces a portion of the conductive ink to be injected as ink droplets onto a print area of a paper to be printed upon. FIG. 1 is a sectional view of the ink jetting device which is substantially the same as that disclosed in the above-noted U.S. Patent. In FIG. 1, a nozzle 1 includes a tube 2 which is filled with a conductive ink 3 supplied from an ink tank or supply 4. The tube 2 is opened at its upper end to form a nozzle hole or opening. A pair of electrodes 5 and 6 with a predetermined gap therebetween are arranged below a level of the ink 3 within the tube 2. The electrodes 5 and 6 are connected to a power supply 7. When a switch 8 is closed, a voltage is applied across the electrodes 5 and 6. A reference numeral 9 designates a paper to be printed upon, and a reference numeral 10 designates droplets of the ink 3 propelled out from the nozzle hole to form a dot upon the print area of the paper 9.

Operations of the ink letting device as described above are as follows:

When the switch 8 is closed to apply the voltage across the electrodes 5 and 6, a current flow is generated through the conductive ink 3 contained in the gap between the electrodes 5 and 6 so that the Joule heat is produced. As a result, a portion of the energized ink 3 is vaporized into the form of bubbles which expand to exert a high pressure or force upon the ink above the gap so that the ink droplets 10 are propelled out from the nozzle hole onto the print area of the paper 9. In practice, there are multiple sets of nozzles 1, each having a corresponding pair of the electrodes 5 and 6 and the switch 8. By operating the switches 8 to select the particular pair or pairs of the electrodes 5 and 6 to be applied with the voltage, a desired letter or character can be printed on the paper 9 by a plurality of dots each formed by the ink droplets 10 jetted from the corresponding nozzle 1.

The prior art ink jetting device as described above, however, has the following problem:

When a large number of the nozzles 1 are provided, since each nozzle 1 must include its own pair of the electrodes 5 and 6, the number of the electrodes 5 and 6 inevitably amounts to quite large in total and thus the corresponding wirings also become complicated. As a result, the high densification of the nozzles which is essential for improving the printing characteristics, is very difficult to be realized.

SUMMARY OF THE INVENTION

Therefore, it is an object of the present invention to provide an improved ink discharging device that can eliminate the above-noted defects inherent in the prior art.

It is another object of the present invention to provide an ink discharging device which can reduce the number of electrodes provided at ink flow paths each leading to a nozzle opening through which a conductive ink is discharged and thus which can also simplify a corresponding wiring structure for supplying powers to the electrodes.

It is still another object of the present invention to provide an ink discharging device which enables high densification of the whole device so as to provide a high printing density with a compact structure.

It is a further object of the present invention to provide an ink cartridge incorporating the above-noted ink discharging device.

It is a still further object of the present invention to provide an ink printer incorporating the above-noted ink cartridge.

To accomplish the above-mentioned and other objects, according to one aspect of the present invention, an ink discharging device comprises ink flow paths arranged adjacent to each other, each of the ink flow paths leading to a corresponding nozzle opening; and electrodes for selectively energizing a conductive ink contained in the ink flow paths so as to force a portion of the conductive ink out of the corresponding nozzle opening, each of the electrodes provided between the adjacent ink flow paths in such a manner as to be exposed to both of the adjacent ink flow paths.

According to another aspect of the present invention, an ink cartridge comprises an ink discharging device which includes ink flow paths arranged adjacent to each other, each of the ink flow paths leading to a corresponding nozzle opening; a common ink chamber leading to each of the ink flow paths for supplying a conductive ink thereinto; and electrodes, each of the electrodes provided at a flow path defining wall arranged between the adjacent ink flow paths in such a manner as to be exposed to both of the adjacent ink flow paths; the ink cartridge further comprising circuit means for controlling electric conditions of the electrodes in response to a control signal fed from outside so as to selectively energize the conductive ink contained in the ink flow paths to force a portion of the conductive ink out of the corresponding nozzle opening; a casing including the ink discharging device and the circuit means; and an ink reservoir provided within the casing for supplying the conductive ink to the common ink chamber.

According to still another aspect of the present invention, a printer comprises an ink cartridge which includes an ink discharging device including ink flow paths arranged adjacent to each other, each of the ink flow paths leading to a corresponding nozzle opening; a common ink chamber leading to each of the ink flow paths for supplying a conductive ink thereinto; and electrodes, each of the electrodes provided at a flow path defining wall arranged between the adjacent ink flow paths in such a manner as to be exposed to both of the adjacent ink flow paths; the ink cartridge further including circuit means for controlling electric conditions of the electrodes in response to a control signal so as to selectively energize the conductive ink contained in the ink flow paths to force a portion of the conductive ink out of the corresponding nozzle opening; a casing including the ink discharging device and the circuit means; and an ink reservoir provided within the casing for supplying the conductive ink to the common ink chamber; the printer further comprising control means for producing the control signal to be fed to the circuit means; a platen for supporting a paper to be printed upon; and a carriage for holding the ink cartridge, the carriage being movable along the platen.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings:

FIGS. 2A and 2B are hereinafter collectively referred to as FIG. 2.

DESCRIPTION OF THE PREFERRED EMBODIMENT

Figure 1:
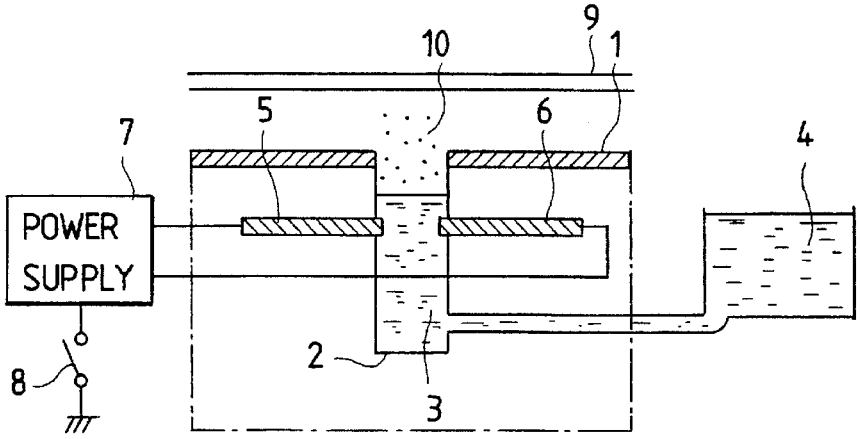
FIG. 1 PRIOR ART
FIG. 1 is a sectional view showing a conventional ink jetting device.

Referring now to the drawings, a preferred embodiment of the present invention will be described with reference to FIGS. 2 to 8.

Figure 3:
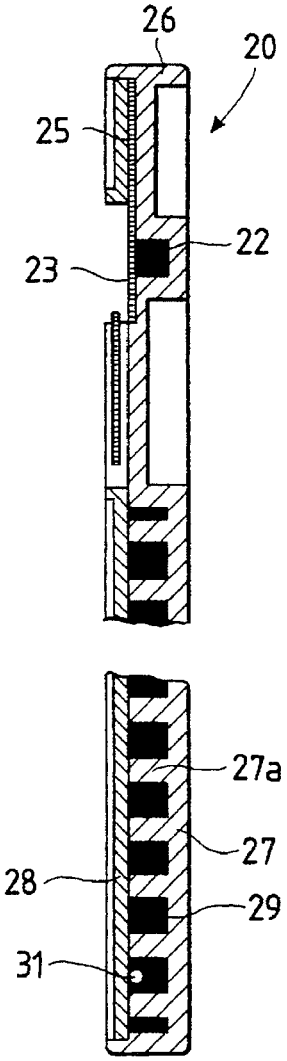
FIG. 3 is a sectional view taken along a line A—A in FIG. 2.
Figure 2A:
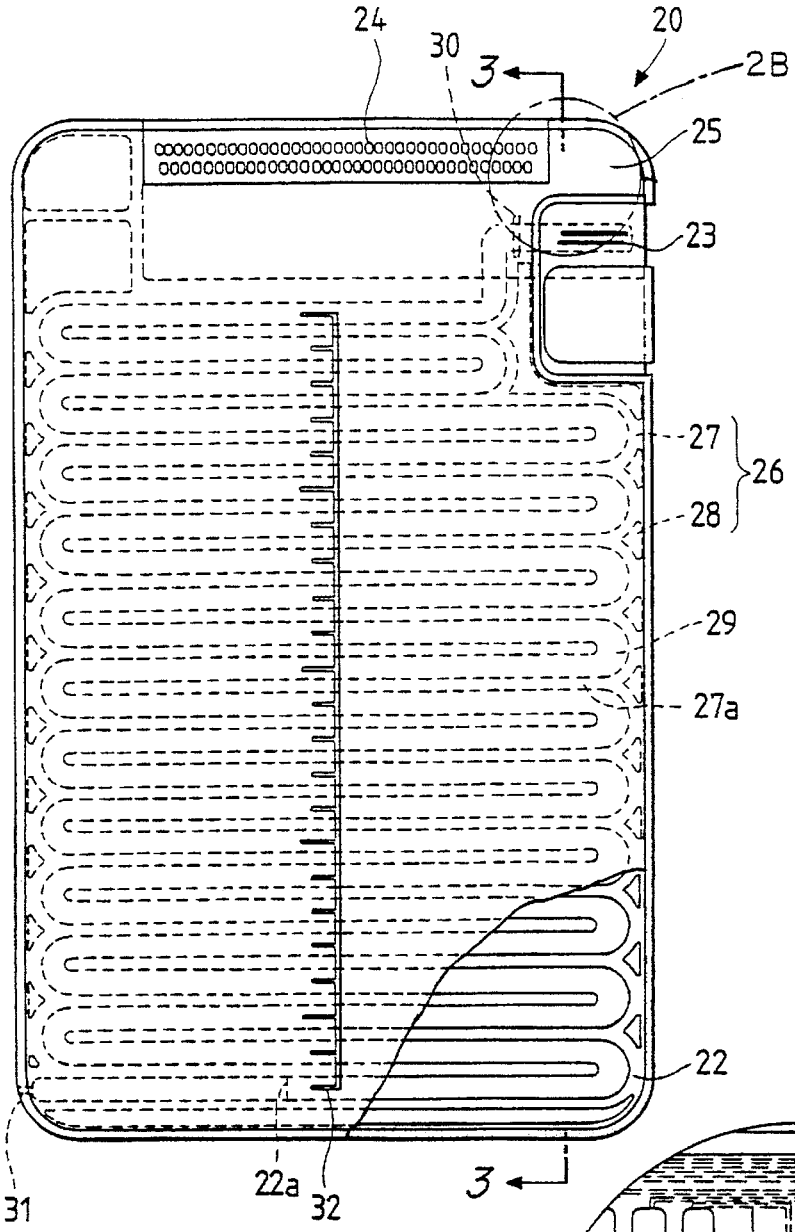
FIG. 2A is a partly broken plan view of an ink jet cartridge incorporating an ink jetting device according to a preferred embodiment of the present invention.
Figure 2B:
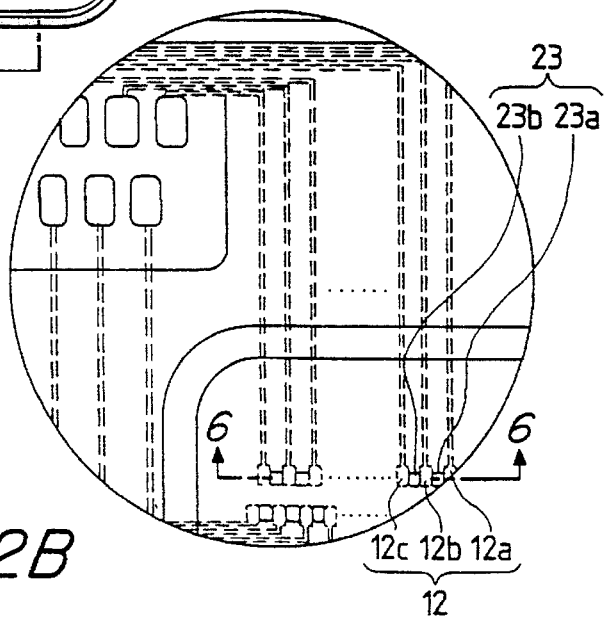
FIG. 2B is an enlarged view of an encircled portion 2B of FIG. 2A.

FIGS. 2 and 3 respectively show an ink jet cartridge 20 incorporating an ink jetting device of the preferred embodiment of the present invention. In FIGS. 2 and 3, the ink jet cartridge 20 includes a nozzle arrayed section forming a print head where a number of nozzles 23 (23*a*, 23*b* . . .) having nozzle holes or openings are set in array for injecting a conductive ink 22 through the nozzle openings. In the nozzle arrayed section, electrodes 12 (12*a*, 12*b*, 12*c* . . .) are also set in array so as to alternate with the nozzle openings as clearly shown in the enlarged encircled view in FIG. 2. The electrodes 12 control generation of current flows through the conductive ink 22 contained in the respective nozzles 23, which will be described later in detail. The ink jet cartridge 20 further includes a terminal arrayed section where a number of terminals 24 are set in array. The terminals 24 transmit control signals fed from outside to the respective electrodes 12 so as to control the energization of the conductive ink 22 in the corresponding nozzles 23 according to the inputted control signals. These nozzles 23, electrodes 12 and the terminals 24 are all provided on a head base 25 as one unit. The ink jet cartridge 20 further includes an ink storage section 26 having a case body 27 and a case cover 28 both made of transparent resin. The case body 27 supports the head base 25 and formed thereon with an ink reservoir or tank 29 which is sealed by the case cover 28 bonded to the case body 27. The ink reservoir 29 is partitioned by a plurality of ribs 27*a* so as to be formed into one flow path for the conductive ink 22 to the nozzle arrayed section. A filter 30 is disposed between a downstream end of the ink reservoir 29 and an upstream end of the nozzle arrayed section for removing contaminants and bubbles contained therein. A communication hole 31 is further provided for connecting the ink reservoir 29 to the outside thereof so as to maintain the ink 22 within the ink reservoir 29 at the atmospheric pressure.

Operations of the ink jet cartridge 20 as described above are as follows:

The conductive ink 22 filled in the ink reservoir 29 is fed to the nozzle arrayed section through the filter 30 by means of the capillary action so as to fill the nozzle arrayed section with the ink 22. When passing the filter 30, contaminants and bubbles in the passing ink 22 are removed. With the conductive ink 22 being filled in the nozzle arrayed section, the control signals are fed to the electrodes 12 via the terminals 24 to energize the conductive ink 22 contained in the desired nozzles 23. The energized ink 22 is heated by its own Joule heat so that a portion of the energized ink 22 is vaporized to generate an expansion pressure which is exerted onto adjacent portions of the ink 22 to propel out ink droplets through the corresponding nozzle holes onto a surface of a paper to be printed upon.

Figure 4:
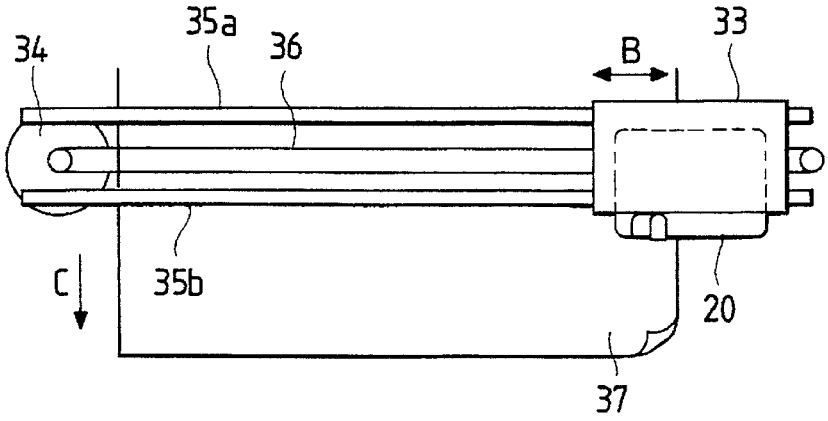
FIG. 4 is a schematic plan view showing a main portion of an ink jet printer incorporating the ink jet cartridge of FIG. 2.
Figure 5:
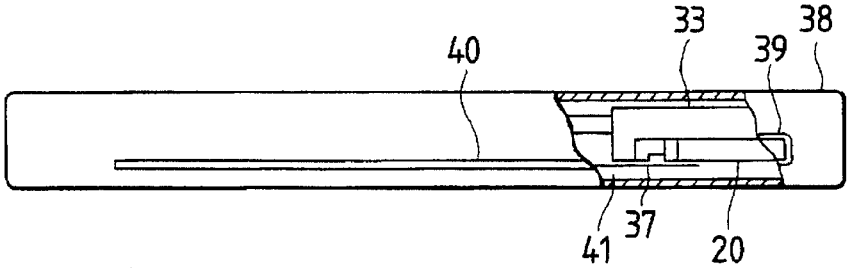
FIG. 5 is a partly broken front view showing the ink jet printer of FIG. 4, with an outer casing thereof.

FIGS. 4 and 5 respectively show an ink jet printer incorporating the ink jet cartridge 20 as described above. In FIGS. 4 and 5, the ink jet cartridge 20 is held by a carriage 33 which is driven by a motor 34. Specifically, a driving force of the motor 34 is transmitted to the carriage 33 by means of a belt 36 so as to move the carriage 33, being guided by a pair of shafts 35*a* and 35*b*, in a direction perpendicular to a feeding direction of a paper 37. In FIG. 5, a reference numeral 38 designates an outer casing of the ink jet printer, a reference numeral 39 designates a mounting opening formed through the outer casing 38 for mounting the ink jet cartridge 20 onto the carriage 33, and a reference numeral 40 designates a paper outlet for the paper 37.

The ink jet printer as described above performs printing onto the paper 37 in the following manner:

The motor 34 actuates the carriage 33 via the belt 36 to move in directions B reciprocatingly, and the paper 37 is fed in a direction C by means of rollers etc., being supported on a platen 41. Simultaneously, the ink droplets of the conductive ink 22 are jetted from the nozzle holes of the arrayed nozzles 23 onto the print area of the paper 37.

Figure 6:
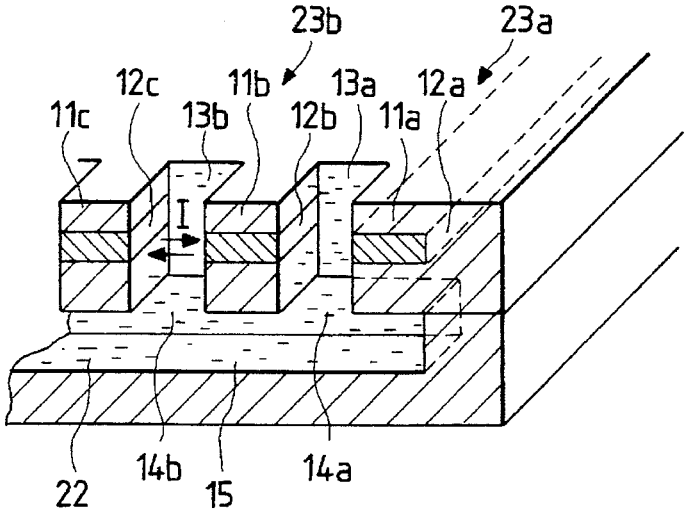
FIG. 6 is a perspective sectioned view showing a portion of the ink jetting device of the preferred embodiment, taken along a line X—X in FIG. 2.

FIG. 6 shows the ink jetting device of the preferred embodiment, which is incorporated in the ink jet cartridge of FIG. 2.

In FIG. 6, the nozzle 23*a* includes a nozzle hole or opening 13*a* and an ink flow path 14*a* leading to the nozzle opening 13*a*. The ink flow path 14*a* is defined between path defining walls 11*a* and 11*b*. Similarly, the nozzle 23*b* includes a nozzle opening 13*b* and a corresponding ink flow path 14*b* leading to the nozzle opening 13*b*. The ink flow path 14*b* is defined between a path defining wall 11*c* and the path defining wall 11*b*. The electrode 12*a* is arranged in the path defining wall 11*a* to form a portion of the path defining wall 11*a* in such a manner as to be exposed to the ink flow path 14*a*. The electrode 12*b* is arranged in the path defining wall 11*b* to form a portion of the path defining wall 11*b* in such a manner as to be exposed to the ink flow path 14*a* at one side and to the ink flow path 14*b* at the other and opposite side. Similarly, the electrode 12*c* is arranged in the path defining wall 11*c* to form a portion of the path defining wall 11*c* in such a manner as to be exposed to the ink flow path 14b at one side and to an adjacent ink flow path (not shown) at the other and opposite side. Accordingly, the electrode 12b works as a common electrode for both the ink flow path 14a and the ink flow path 14b, and the electrode 12c works as a common electrode in a similar manner. A reference numeral 15 designates a common ink chamber extending along the nozzle arrayed section and leading to each ink flow path as shown in FIG. 6. The common ink chamber 15 communicates with the ink reservoir 29 via the filter 30 for feeding the conductive ink 22 to each ink flow path.

The ink jetting device as described above operates as follows:

When an alternating voltage is applied across the electrodes 12b and 12c, electric lines of force are generated as indicated by arrows I in FIG. 6. As a result, corresponding currents flow through the conductive ink 22 along the lines I so that the energized ink 22 is self-heated by the Joule heat to be boiled so as to generate bubbles therein. The expansion pressure of the bubbles is exerted onto the conductive ink 22 near the nozzle opening 13b so that the ink droplets are jetted out through the nozzle opening 13b to impinge upon the print area of the paper 37 in FIG. 4. In this way, a corresponding dot is printed thereon. The conductive ink 22 thus consumed is constantly supplemented from the common ink chamber 15 to the ink flow path 14b.

Figure 7:
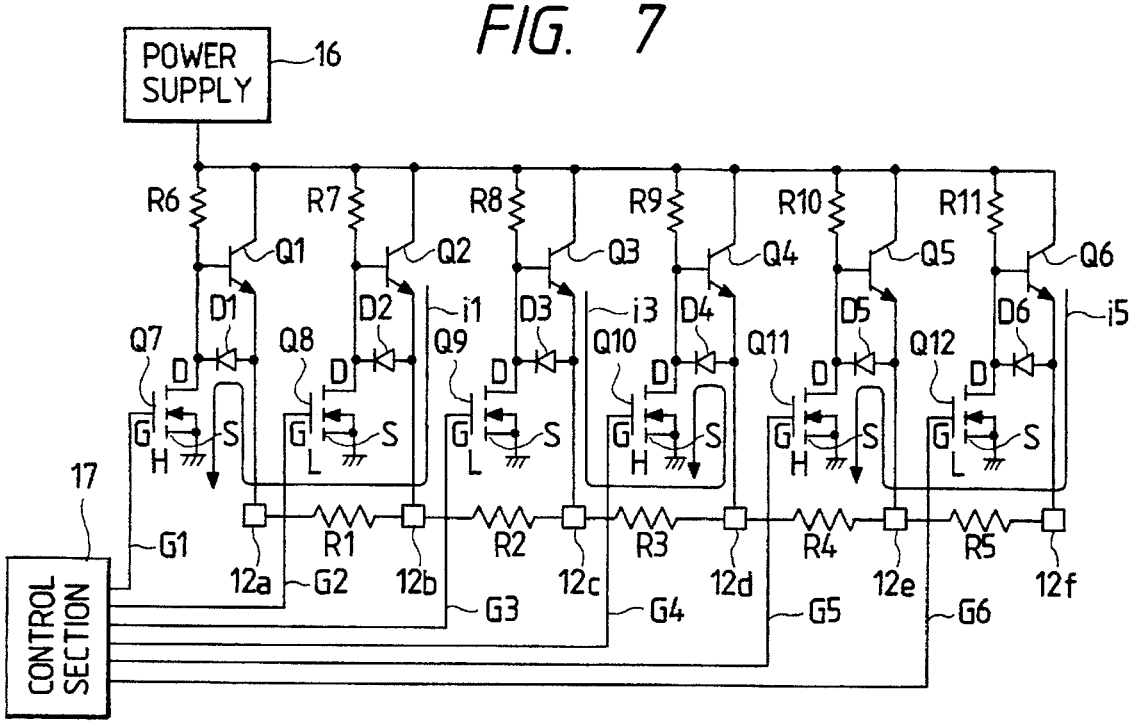
FIG. 7 is a circuit diagram for controlling operations of the ink jetting device of FIG. 6.

FIG. 7 shows a circuit diagram for controlling operations of the ink jetting device as described above. In FIG. 7, Q1 to Q6 respectively designate bipolar transistors. Collectors of the bipolar transistors Q1 to. Q6 are respectively connected to a power supply 16, emitters thereof are respectively connected to the electrodes 12a to 12f, and bases thereof are respectively connected to drains D of field effect transistors (FET's) Q7 to Q12. Sources S of FET's Q7 to Q12 are respectively grounded, and gates G thereof are respectively connected to control signal lines G1 to G6 which in turn are connected to a control section 17. Cathodes of diodes D1 to D6 are respectively connected to the bases of the bipolar transistors Q1 to Q6 and to the drains D of FET's Q7 to Q12, while anodes thereof are respectively connected to the emitters of the bipolar transistors Q1 to Q6 and to the electrodes 12a to 12f. Resistors R1 to R5 respectively represent electrical resistance of the conductive ink 22 between the electrodes 12a and 12b, between 12b and 12c, between 12c and 12d, between 12d and 12e, and between 12e and 12f, respectively. Resistors R6 to R11 are further provided which are respectively connected to the power supply 16, to the bases of the bipolar transistors Q1 to Q6 and to the drains D of FET's Q7 to Q12. The control section 17 outputs control signals to the respective gates G of FET's Q7 to Q12 via the control signal lines G1 to G6 for controlling switching operations thereof. The switching operations of FET's Q7 to Q12 control the energization of the conductive ink 22 (R1 to R5) via the electrodes 12a to 12f.

The circuit of FIG. 7 operates in the following manner to control the operations of the ink jetting device of FIG. 6:

It is assumed that a pattern of the control signals fed from the control section 17 to the respective control signal lines G1 to G6 is H, L, L, H, H, L as indicated in FIG. 7, wherein H represents a positive voltage and L represents zero voltage. Under this signal pattern, FET Q7 turns ON to allow a drain current to flow from the drain D to the source S. Accordingly, the bipolar transistor Q2 turns ON so that a current i1 flows through the ink resistor R1 as indicated in FIG. 7. Similarly, FET Q10 and the bipolar transistor Q3 turn ON so that a current i3 flows through the ink resistor R3 as indicated in FIG. 7. Similarly, FET Q11 and the bipolar transistor Q6 turn ON so that a current i5 flows through the ink resistor R5 as indicated in FIG. 7.

Figure 8:
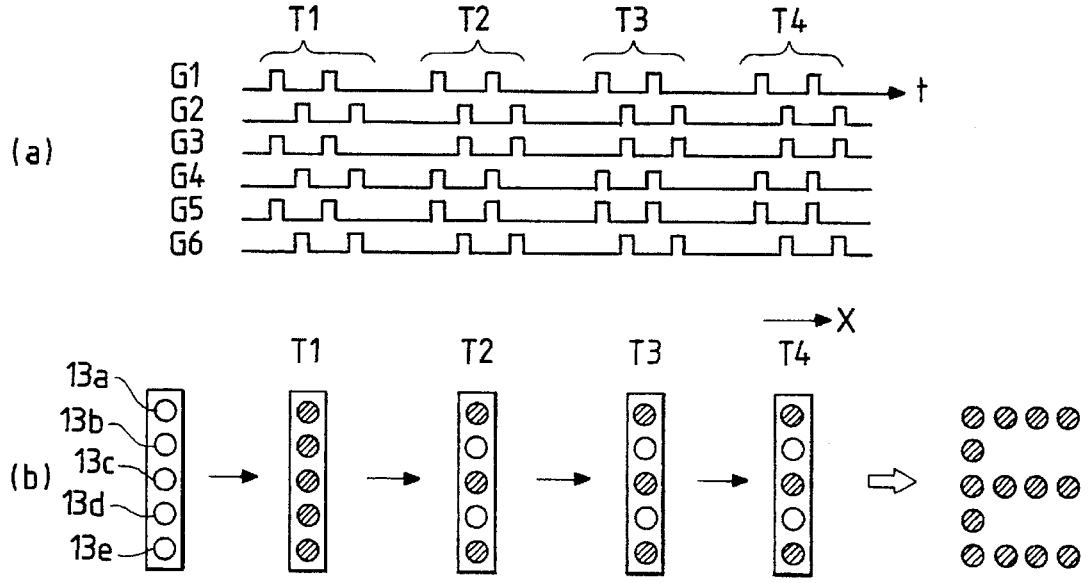
FIG. 8(a) illustrates time-domain diagrams, one showing waveforms of signals for controlling operations of field effect transistors (FET's) incorporated in the circuit diagram of FIG. 7, the other showing a print pattern performed by the ink jetting device of FIG. 6.

FIG. 8(*a*) shows a timechart of the control signals fed to the signal lines G1 to G6 for controlling operations of FET's Q7 to Q12 in the circuit of FIG. 7. FIG. 8(*b*) shows a time-domain diagram of a print pattern performed by the ink jetting device of FIG. 6.

It is assumed that the print head includes five nozzle holes 13a to 13e and is moved in a direction X to print a letter E. During a time period T1, the control signals fed to the signal lines G1 to G6 repeat a pattern 1 (H, L, H, L, H, L) and a pattern 2 (L, H, L, H, L, H). Specifically, as clear from the foregoing description of the drive circuit in FIG. 7, when the pattern 1 or the pattern 2 is applied to FET's Q7 to Q12, all the ink resistors R1 to R5 are energized so that the conductive ink 22 is jetted out through all the nozzle holes 13a to 13e. The reason for repetition of the patterns 1 and 2 is to produce alternating currents passing through the respective ink resistors R1 to R5 so as to prevent generation of the electrolysis at the respective electrodes 12a to 12f facing the conductive ink 22. The number of the repetition of the patterns 1 and 2 as well as its frequency vary depending on a time required for the conductive ink 22 to be boiled and a wear tolerance of the electrodes 12a to 12f. Nevertheless, it is preferable to repeat the patterns 1 and 2 30 to 70 times at a frequency of 1 MHz or higher.

It is to be appreciated that during the time period T1 a pattern 3 (L, L, L, L, L, L) may be put between the patterns 1 and 2.

Subsequently, during time periods T2, T3 and T4, the control signals repeat a pattern 4 (H, L, L, H, H, L) and a pattern 5 (L, H, H, L, L, H) so as to pass alternating currents through the ink resistors R1, R3 and R5. As a result, the conductive ink 22 is jetted out through the corresponding nozzle holes 13a, 13c and 13e so that the letter E is printed onto the print area of the paper 37.

As appreciated from the foregoing description, according to the preferred embodiment of the present invention, since each electrode is arranged to work as a common electrode for two adjacent ink flow paths, the electrode arrangement as well as its wiring can be made significantly simplified so that an interval between the adjacent ink flow paths can be made very short to allow the high densification of the nozzles.

It is to be understood that this invention is not to be limited to the preferred embodiments and modifications described above, and that various changes and modifications may be made without departing from the spirit and scope of the invention as defined in the appended claims. For example, the number of the nozzle holes is not to be limited to five and any number may be taken according to structures and requirements.

What is claimed is:

1. An ink discharging device comprising:

ink flow paths arranged adjacent to each other, each of said ink flow paths containing therein a conductive ink and leading to a corresponding nozzle opening; and electrodes, each of said electrodes provided between corresponding adjacent ink flow paths in such a manner as to be exposed to both of said corresponding adjacent ink flow paths, said electrodes each being located a given distance from a corresponding nozzle opening, a potential control being effected on all of said electrodes such that a difference in potential is effected across the electrodes provided at both sides of the ink flow path leading to the nozzle opening through which the conductive ink is discharged, while no difference in potential being effected across the electrodes provided at both sides of the ink flow path leading to the nozzle opening through which no conductive ink is discharged;

wherein the conductive ink is selectively discharged through the nozzle opening corresponding to said each ink flow path due to a pressure of a bubble generated in the conductive ink of said each ink flow path which results from the difference in potential being applied across the electrodes provided at both sides of said each ink flow path to energize the conductive ink between said voltage-applied electrodes.

2. The ink discharging device as set forth in claim 1, wherein a common ink chamber is provided, said common ink chamber leading to each of said ink flow paths for supplying the conductive ink thereinto, and wherein each of said electrodes is provided in a flow path defining wall arranged between corresponding adjacent ink flow paths.

3. The ink discharging device as set forth in claim 1, wherein an alternating voltage is applied across the electrodes for energizing the conductive ink contained in the corresponding ink flow path.

4. The ink discharging device as set forth in claim 3, wherein a frequency of said alternating voltage is set to a value so as to suppress generation of electrolysis at the electrodes.

5. The ink discharging device as set forth in claim 4, wherein said frequency is set to 1 MHz or higher.

6. An ink cartridge comprising:

an ink discharging device which includes:

ink flow path arranged adjacent to each other, each of said ink flow paths leading to a corresponding nozzle opening;

a common ink chamber leading to each of said ink flow paths for supplying a conductive ink thereinto; and electrodes, each of said electrodes provided at a flow path defining wall arranged between corresponding adjacent ink flow paths such that said each electrode is exposed to both of said corresponding adjacent ink flow paths at a position located a given distance from a corresponding nozzle opening;

said ink cartridge further comprising:

circuit means for applying a voltage across selective ones of said electrodes in response to a control signal so as to effect a potential difference across the electrodes provided at both sides of respective ones of said ink flow paths leading to corresponding nozzle openings through which the conductive ink is discharged and no potential difference across the electrodes provided at both sides of respective ones of said ink flow paths leading to corresponding nozzle openings through which the conductive ink is not discharged, so that a portion of the conductive ink at said respective ones of said ink flow paths between adjacent electrodes to which the potential difference is effected is forced out of said corresponding nozzle openings by means of a pressure of a bubble generated in the conductive ink at said respective ones of said ink flow paths due to energization thereof;

a casing including said ink discharging device and said circuit means; and an ink reservoir provided within said casing for supplying the conductive ink to said common ink chamber.

7. The ink cartridge as set forth in claim 6, wherein said circuit means applies an alternating voltage across the electrodes so as to pass an alternating current through the conductive ink contained in the corresponding ink flow path.

8. The ink cartridge as set forth in claim 7, wherein a frequency of said alternating voltage is set to a value so as to suppress generation of electrolysis at the electrodes.

9. The ink cartridge as set forth in claim 8, wherein said frequency is set to 1 MHz or higher.

10. A printer comprising:

an ink cartridge which includes:

an ink discharging device including:

ink flow paths arranged adjacent to each other, each of said ink flow paths leading to a corresponding nozzle opening;

a common ink chamber leading to each of said ink flow paths for supplying a conductive ink thereinto; and electrodes, each of said electrodes provided at a flow path defining wall arranged between corresponding adjacent ink flow paths in such a manner as to be exposed to both of said corresponding adjacent ink flow paths at a position located a given distance from a corresponding nozzle opening;

said ink cartridge further including:

circuit means for applying a voltage across selective ones of said electrodes in response to a control signal so as to effect a potential difference across the electrodes provided at both sides of respective ones of said ink flow paths leading to corresponding nozzle openings through which the conductive ink is discharged and no potential difference across the electrodes provided at both sides of respective ones of said ink flow paths leading to corresponding nozzle openings through which the conductive ink is not discharged, so that a portion of the conductive ink at said respective ones of said ink flow paths between adjacent electrodes to which the potential difference is effected is forced out of said corresponding nozzle openings by means of a pressure of a bubble generated in the conductive ink at said respective ones of said ink flow paths due to energization thereof;

a casing including said ink discharging device and said circuit means; and an ink reservoir provided within said casing for supplying the conductive ink to said common ink chamber;

said printer further comprising:

control means for producing said control signal to be fed to said circuit means;

a platen for supporting a paper to be printed upon; and a carriage for holding said ink cartridge, said carriage being movable along said platen.

11. The printer as set forth in claim 10, wherein said control signal is so arranged as to apply an alternating voltage across the electrodes for passing an alternating current through the conductive ink contained in the corresponding ink flow path.

12. The printer as set forth in claim 11, wherein a frequency of said alternating voltage is set to a value so as to suppress generation of electrolysis at the electrodes.

13. The printer as set forth in claim 12, wherein said frequency is set to 1 MHz or higher.

* * * * *